US008791684B2

(12) United States Patent
Lym et al.

(10) Patent No.: US 8,791,684 B2
(45) Date of Patent: Jul. 29, 2014

(54) REFERENCE VOLTAGE GENERATOR

(75) Inventors: Sang Kug Lym, Icheon (KR); Yoon Jae Shin, Icheon (KR)

(73) Assignee: SK Hynix Inc., Icheon (KR)

( * ) Notice: Subject to any disclaimer, the term of this patent is extended or adjusted under 35 U.S.C. 154(b) by 85 days.

(21) Appl. No.: 13/551,000

(22) Filed: Jul. 17, 2012

(65) Prior Publication Data

US 2013/0293215 A1 Nov. 7, 2013

(30) Foreign Application Priority Data

May 4, 2012 (KR) ..... 10-2012-0047417

(51) Int. Cl.
*G05F 3/16* (2006.01)

(52) U.S. Cl.
USPC ..... 323/313

(58) Field of Classification Search
USPC ..... 323/311–316, 901, 907; 363/49; 327/539, 540
See application file for complete search history.

(56) References Cited

U.S. PATENT DOCUMENTS

| | | | | |
|---|---|---|---|---|
| 4,839,535 | A * | 6/1989 | Miller | 327/539 |
| 5,532,579 | A * | 7/1996 | Park | 323/314 |
| 5,587,655 | A * | 12/1996 | Oyabe et al. | 323/312 |
| 6,016,051 | A * | 1/2000 | Can | 323/315 |
| 7,446,599 | B1 * | 11/2008 | Wang | 327/539 |
| 7,990,130 | B2 * | 8/2011 | Yoshikawa | 323/313 |

* cited by examiner

*Primary Examiner* — Adolf Berhane

(57) ABSTRACT

A reference voltage generator generates a reference voltage having a stable voltage level insensitive to a temperature variation. A reference voltage generator includes a current generating unit configured to generate a reference current proportional to temperature increase, a voltage adjusting unit configured to adjust a reference voltage corresponding to a current level of the reference current, and a start-up driving unit configured to drive and amplify the reference voltage while the voltage adjusting unit operates.

16 Claims, 2 Drawing Sheets

<Prior Art>

REFERENCE VOLTAGE GENERATOR

CROSS-REFERENCE TO RELATED APPLICATION

The priority of Korean patent application No. 10-2012-0047417 filed on May 4, 2012 the disclosure of which is hereby incorporated in its entirety by reference, is claimed.

BACKGROUND OF THE INVENTION

The present invention relates to a reference voltage generator, and more specifically, to a reference voltage generator of a semiconductor memory device capable of generating a reference voltage having a stable voltage level regardless of temperature variation.

Generally, reference voltage generating circuits, which are used for an analog to digital converter (ADC), a digital to analog converter (DAC), and a low voltage dynamic random access memory (DRAM) device, are used to obtain a reference voltage having a voltage level insensitive to a variation in a temperature or a power voltage level.

In the conventional art, in order to obtain an accurate reference voltage, a reference voltage generator using a silicon band gap is often used. In order to generate a reference voltage having a stable voltage level even when there is a change in temperature, a voltage having a negative coefficient with respect to the temperature variation and a voltage having a positive coefficient with respect to the temperature variation are generated and added so that the temperature change coefficient may be '0'.

A voltage difference between a base and an emitter of a transistor is used as the negative coefficient voltage, and a voltage difference between a base and an emitter of another transistor, which is proportional to an absolute temperature, is used as the positive coefficient voltage.

FIG. 1 illustrates a circuit diagram of a conventional reference voltage generator.

Referring to FIG. 1, the conventional reference voltage generator includes a current generating unit 10, a reference voltage output unit 20 and a level shifter 30.

The current generating unit 10 generates a supply current It. The reference voltage output unit 20 outputs a first reference voltage Vout corresponding to the supply current It. The level shifter 30 shifts a voltage level of the first reference voltage Vout to output a second reference voltage Vout2.

The current generating unit 10 includes a current mirror unit 11, a temperature sensing unit 12, and a current supply unit 13.

The current mirror unit 11 supplies a mirrored current. As temperature increases, the temperature sensing unit 12 increases a current value of the mirrored current outputted from the current mirror unit 11. The current supply unit 13 generates the supply current It, which is in synchronization with a variation of the current value of the mirrored current output from the current mirror unit 11.

The current mirror unit 11 includes a plurality of MOS transistors MP0~MP3, MN0, MN1, and a resistor R3.

The MOS transistor MP0 is coupled between a power voltage supply terminal VDD and the MOS transistor MP1. The MOS transistor MP2, coupled between the power voltage supply terminal VDD and the MOS transistor MP3, has a gate coupled with a gate of the MOS transistor MP0.

The MOS transistor MP1 is coupled between the MOS transistor MP0 and the MOS transistor MN0. The MOS transistor MP3, coupled between the MOS transistor MP2 and a first end of the resistor R3, has a gate coupled with a gate of the MOS transistor MP1 and a second end of the resistor R3. The first end of the resistor R3 is further coupled with a common node of the gates of the MOS transistors MP0 and MP2.

The resistor R3, which generates a reference current, is coupled between the MOS transistors MP3 and MN1. As described above, the second end of the resistor R3 is coupled with a common node of the gates of the MOS transistors MP1 and MP3.

The MOS transistor MN0, coupled between the MOS transistor MP1 and a bipolar transistor PNP0, has a gate coupled with a drain thereof. The MOS transistor MN1, coupled between the resistor R3 and a resistor R2, has a gate coupled with a common node of the gate and drain of the MOS transistor MN0.

Meanwhile, the temperature sensing unit 12 includes the bipolar transistors PNP0, a bipolar transistor PNP1, and the resistor R2.

The bipolar transistor PNP0, coupled between the MOS transistor MN0 and a ground voltage supply terminal VSS, has a base coupled to the ground voltage supply terminal VSS. The bipolar transistor PNP1, coupled between the resistor R2 and the ground voltage supply terminal VSS, has a base coupled with the base of the bipolar transistor PNP0.

The current supply unit 13 includes MOS transistors MP4 and MP5.

The MOS transistor MP4 and the MOS transistor MP5 are coupled in series between the power voltage supply terminal VDD and a node for outputting the first reference voltage Vout. The MOS transistor MP4 has a gate coupled with the gate of the MOS transistor MP2. The MOS transistor MP5 has a gate coupled with the gate of the MOS transistor MP3.

The reference voltage output unit 20 includes a resistor R1 and a bipolar transistor PNP2 that are serially coupled to each other.

The resistor R1 receives the supply current It through a first end. The bipolar transistor PNP2 is coupled between a second end of the resistor R1 and the ground voltage supply terminal VSS, and a base of the bipolar transistor PNP2 is coupled to the base of the bipolar transistors PNP0 and PNP1.

Meanwhile, a Widler type or band gap reference (BGR) type scheme has been widely used in a conventional reference voltage generator used in memory chips.

Although such reference voltage generator has benefits with respect to variations in manufacturing processes and power voltage, reference voltage level is sensitive to and may change depending on temperature variation, so that a voltage level of a source power of a transistor or a voltage level of a voltage generated from the comparison with a reference voltage is not stable. As a result, margin shortage or errors in a core operation of a semiconductor memory device may occur.

Moreover, a bipolar junction transistor (BJT) is used in the conventional reference voltage generator. A BJT occupies a large physical space, and its continuous operation causes large current consumption.

An analog circuit used in an integrated circuit primarily uses a bias circuit to set an operational point of the circuit. Particularly, a current reference circuit, which is a current source, is required to determine an operational characteristic of direct current (DC) and alternating current (AC) operations. The widely used bias circuit is affected by the variations of temperature, power voltage level, and manufacturing process.

Thus, a new bias circuit, which is less affected by variations of temperature, power voltage, and manufacturing process, is necessary. However, a conventional circuit that has lower dependency on temperature variation and is included in the conventional reference voltage generator, is complicated, occupies a large area in the semiconductor chip, and consumes a lot of power.

BRIEF SUMMARY OF THE INVENTION

Embodiments of the present invention are directed to providing a reference voltage generator for generating a stable reference voltage by using a beta-multiplier scheme to allow transistors to operate in a weak inversion region, so that a stage of compensating a current proportional to temperature variation and a stage of using a threshold voltage inversely proportional to the temperature variation are implemented in the reference voltage generator. The current proportional to the temperature variation is proportional to absolute temperature current IPTAT.

According to an embodiment of the present invention, a reference voltage generator comprises: a current generating unit configured to generate a reference current proportional to a temperature increase; a voltage adjusting unit configured to output a reference voltage corresponding to a level of the reference current; and a start-up driving unit configured to drive and amplify the reference voltage while the voltage adjusting unit operates.

The current generating unit comprises: a temperature sensing unit configured to sense the temperature to adjust output impedance according to a temperature variation; and a current mirror unit configured to generate the reference current corresponding to the output impedance and output the reference current to a first node.

The temperature sensing unit is configured to reduce the output impedance as the temperature increases.

The voltage adjusting unit comprises: a current supply unit configured to output a supply current to a second node, the supply current corresponding to a changing amount of the reference current; and a diode unit configured to control a current value of the supply current by inducing a negative temperature coefficient.

The diode unit comprises at least one NMOS transistor that is coupled to and disposed between the second node and a ground voltage terminal and that is formed to have a diode type, and wherein a current value of the second node is controlled by using a gate-source voltage of the NMOS transistor as the negative temperature coefficient.

The start-up driving unit comprises: an output driving unit configured to be selectively driven in response to an output signal of the voltage adjusting unit to control a voltage level of the reference voltage; a driving element configured to selectively pull down an output node of the reference voltage in response to an output signal of the output driving unit; and a charge element configured to charge the output node of the reference voltage.

The output driving unit comprises an inverting element that is coupled to and disposed between a power voltage terminal and a ground voltage terminal and that has an input node coupled to the output node of the reference voltage.

The driving element comprises at least one NMOS transistor that is coupled to and disposed between an output node of the current generating unit and a ground voltage terminal and that has a gate coupled to an output node of the output driving unit.

The charge element includes a MOS capacitor having a gate coupled to the output node of the reference voltage.

The driving element is turned off so that the charge element operates when the output node of the reference voltage is at a high level, and wherein the driving element is turned on when the output node of the reference voltage is at a low level.

The current mirror unit comprises a pair of PMOS transistors coupled to each other to form a current mirror.

The temperature sensing unit comprises a pair of NMOS transistors having a common gate, which are coupled to and disposed between the current mirror unit and a ground voltage terminal and operates in a weak inversion region, a first one of the NMOS transistor pair having a drain coupled to the common gate.

The temperature sensing unit further comprises a resistance element between a source of a second one of the NMOS transistor pair and the ground voltage terminal.

The current supply unit comprises at least one PMOS transistor that is coupled to and disposed between a power voltage terminal and the second node, and wherein the current supply unit receives the reference current through a gate of the at least one PMOS transistor.

The current generating unit configured to operate in a weak inversion region.

The voltage adjusting unit configured to output a reference voltage by using a offset characteristic of a positive temperature coefficient and a negative temperature coefficient that occurs when the positive temperature coefficient increases and the negative temperature coefficient decreases during the temperature increase, insensitive to the temperature variation, wherein the positive temperature coefficient corresponds to the reference current.

DESCRIPTION OF EMBODIMENTS

Embodiments of the present invention will be described in detail with reference to the attached drawings.

In order to regulate a high level voltage or generate an internal power voltage, a semiconductor device requires a reference voltage generator configured to stably generate a reference voltage. The reference voltage generator outputs a reference voltage having a stable voltage level regardless of variations in a voltage level of an external power voltage, a temperature, or a manufacturing process.

Figure 2:
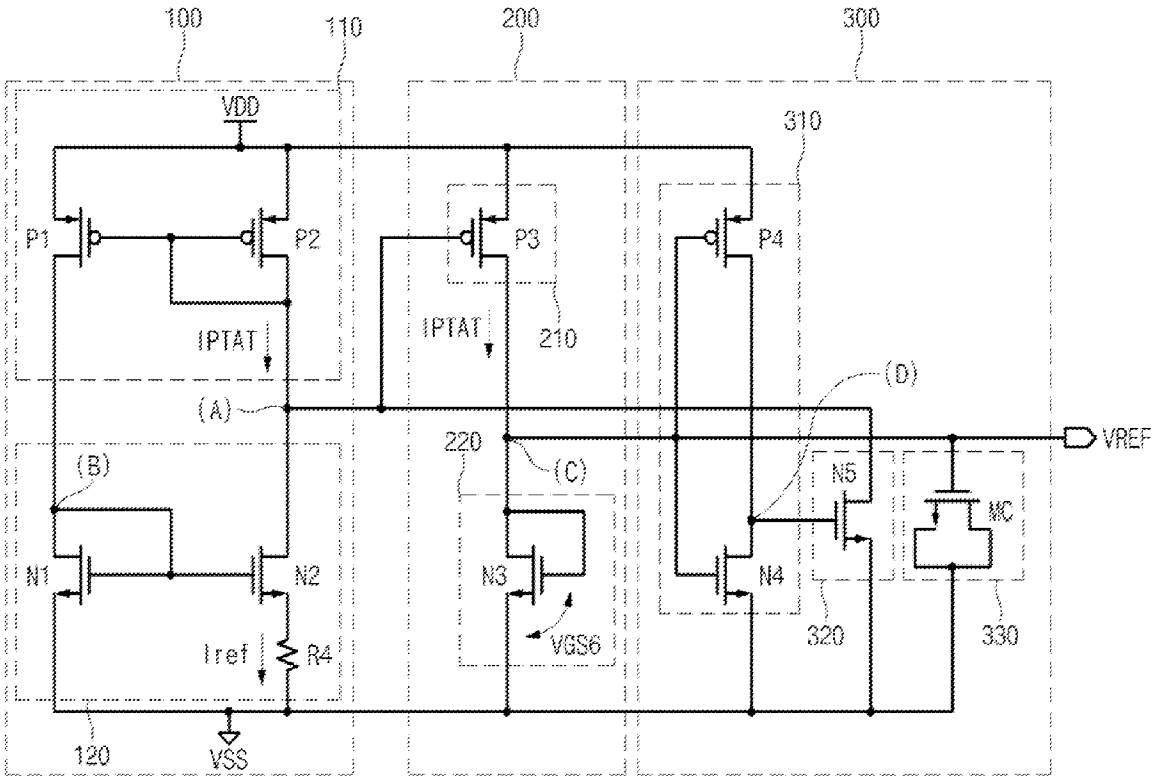
FIG. 2 illustrates a circuit diagram of a reference voltage generator according to an embodiment of the present invention.

FIG. 2 illustrates a circuit diagram of a reference voltage generator according to an embodiment of the present invention.

Referring to FIG. 2, the reference voltage generator includes a current generating unit 100, a voltage adjusting unit 200 and a start-up driving unit 300.

The current generating unit 100 uses a beta(β)-multiplier scheme. The current generating unit 100 includes a current mirror unit 110 and a temperature sensing unit 120. The current mirror unit 110 includes a pair of PMOS transistor P1 and P2 coupled to each other to form a current mirror. The temperature sensing unit 120 includes a pair of NMOS transistors N1 and N2, coupled to each other to form a current mirror, and a resistor R4 for sensing a temperature.

A gate of the PMOS transistor P1 is coupled to a gate of the PMOS transistor P2 and a node (A). A drain and the gate of the PMOS transistor P2 are coupled to each other to form a current mirror with the PMOS transistor P1. Sources of the PMOS transistors P1 and P2 are coupled to a power voltage terminal VDD.

A gate of the NMOS transistor N1 is coupled to a gate of the NMOS transistor N2 and a node (B). A drain and the gate of the NMOS transistor N1 are coupled with each other to form a current mirror with the NMOS transistor N2. A source of the NMOS transistor N1 is coupled with a ground voltage terminal VSS, and a source of the NMOS transistor N2 is coupled with the ground voltage terminal through the resistor R4.

In the temperature sensing unit 120, the relationship between the NMOS transistors N1 and N2 is called a reference voltage generating way of the β-multiplier scheme due to multiple relations. For example, the NMOS transistor N2 has a larger size by K times than that of the NMOS transistor N1.

The reference voltage generating way of the β-multiplier scheme is a key feature for securing a low reference current for low power consumption in the current generating unit 100 using the β-multiplier scheme.

The voltage adjusting unit 200 includes a current supply unit 210 and a diode unit 220. The current supply unit 210 includes a PMOS transistor P3, and the diode unit 220 includes an NMOS transistor N3.

The PMOS transistor P3 and the NMOS transistor N3 are coupled in series between the power voltage terminal and the ground voltage terminal. The PMOS transistor P3 has a gate coupled to the node (A). The NMOS transistor N3 has a gate coupled to its drain to form a diode type.

The start-up driving unit 300 includes an output driving unit 310, a driving element 320, and a charge element 330.

The output driving unit 310 includes a PMOS transistor P4 and an NMOS transistor N4. The driving element 320 includes an NMOS transistor N5. The charge element 330 includes a MOS capacitor MC.

The PMOS transistor P4 and the NMOS transistor N4 are coupled in series between the power voltage terminal and the ground voltage terminal. A gate of the PMOS transistor P4 and a gate of the NMOS transistor N4 are coupled to an output terminal of a reference voltage VREF, i.e., a node (C). The NMOS transistor N5, coupled between the node (A) and the ground voltage terminal, has a gate coupled with a common drain of the PMOS transistor P4 and the NMOS transistor N4.

The MOS capacitor MC including an NMOS capacitor has a gate coupled with the output terminal of the reference voltage VREF.

Hereinafter, an operation of the reference voltage generator shown in FIG. 2 will be explained.

A reference current Iref of the current generating unit 100 is a source current of the NMOS transistors N1 and N2. According to Equation 1 below, if a resistance value of the resistor R4 is increased, a low current value of the reference current Iref is secured.

$$Iref = \frac{(V_{GS1} - V_{GS2})}{R}, \quad \text{[Equation 1]}$$

wherein $V_{GS1}$ is a gate-source voltage of the NMOS transistor N1; $V_{GS2}$ is a gate-source voltage of the NMOS transistor N2; and R is a resistance value of the resistor R4.

As a temperature increases, the temperature sensing unit 120 senses the temperature to reduce output impedance.

The current mirror unit 110 mirrors a reference current IPTAT corresponding to the output impedance of the temperature sensing unit 120 to supply the reference current IPTAT to the node (A).

A drain current $I_D$, flowing in a path of the PMOS transistor P2 to the NMOS transistor N2 in the current generating unit 100, is obtained as shown in Equation 2 since the NMOS transistor N2 operates in a weak inversion region.

$$I_D = \frac{n * VT}{R} * \ln K \quad \text{[Equation 2]}$$

Herein, the NMOS transistor N2 operates in a weak inversion region. In Equation 2, K represents a transistor ratio of the NMOS transistor N2 to the NMOS transistor N1. R represents a resistance value required in a targeted β ratio.

A thermal voltage VT is represented by Equation 3.

$$VT = \frac{kT}{q}, \quad \text{[Equation 3]}$$

wherein q represents an electron charge magnitude; k represents a Boltzmann constant; and T represents a temperature.

According to Equation 3, the thermal voltage VT having a constant voltage level is obtained at room temperature (e.g., 300K) by applying the electron charge magnitude q and the Boltzmann constant k to Equation 3.

Equation 2 can be converted into Equation 4 as shown below.

$$R = \frac{n * VT}{I_D} * \ln K \quad \text{[Equation 4]}$$

Therefore, by applying the constant thermal voltage VT to Equation 2 and Equation 4, it is possible to obtain a target current $I_D$ so that the NMOS transistor N2 can operate in a weak inversion region and a resistance value R required in a targeted 13 ratio.

A temperature coefficient TCI, representing a changing amount of the drain current $I_D$ with respect to the temperature in the PMOS transistor P2 and the NMOS transistor N2, is induced from Equation 2, so that Equation 5 below is obtained.

$$TCI(ppm/^\circ C.) = \frac{1}{I}\frac{dI}{dT} = \frac{1}{VT}\frac{\partial VT}{\partial T} - \frac{1}{R}\frac{\partial R}{\partial T} \quad \text{[Equation 5]}$$

Referring to Equation 5, it is noted that the drain current $I_D$ corresponds to the current IPTAT in proportion to temperature variation.

The current IPTAT is provided to the current supply unit 210.

That is, since values obtained by partially differentiating the drain current $I_D$ with respect to the temperature variation are the thermal voltage VT and the resistance value R, which are increased depending on the temperature, the drain current $I_D$ increases in proportion to the temperature.

The current supply unit 210 supplies a supply current to the diode unit 220. The supply current corresponds to the reference current IPTAT.

If a temperature increases, a threshold voltage of a transistor decreases. On the other hand, if the temperature decreases, the threshold voltage increases. Thus, a current value of the reference voltage VREF can be obtained that has hardly changed with respect to the temperature variation because a parameter of increase and that of decrease in the temperature are balanced.

In the diode unit 220, a drain current is determined by a gate-source voltage $V_{GS6}$. The gate-source voltage $V_{GS6}$ is obtained using Equation 6.

$$V_{GS6} = V_{THN} + \sqrt{\frac{2IPTAT}{\beta}}, \quad \text{[Equation 6]}$$

wherein $V_{THN}$ represents a threshold voltage of the NMOS transistor N3.

Equation 6 may be represented as Equation 7.

$$V_{GS}=V_{th}+(V_{GS}-V_{th}), \quad \text{[Equation 7]}$$

wherein $V_{GS}-V_{th}$ can be calculated with the drain current $I_D$.

$$V_{THN}(T)=V_{THN}(T0)*(1+TCV_{THN}*(T-T0) \quad \text{[Equation 8]}$$

Referring to Equation 8, it is noted that the threshold voltage $V_{THN}$ is a negative temperature coefficient that decreases depending on temperature increase. That is, Equation 8 shows variation of the threshold voltage $V_{th}$ of the NMOS transistor depending on the temperature variation.

In Equation 6, since the current IPTAT is a positive temperature coefficient and the threshold voltage $V_{THN}$ is a negative temperature coefficient, the gate-source voltage $V_{GS6}$ of the diode unit 220 can maintain a constant level with respect to the temperature variation.

As a result, the reference voltage VREF can be less affected by the temperature variation.

The start-up driving unit 300 drives and amplifies the reference voltage VREF while the voltage adjusting unit 200 operates.

The output driving unit 310 includes a PMOS transistor P4 and an NMOS transistor N4, which constitute an inverter. That is, the output driving unit 310 controls a voltage level of the node (D) depending on a voltage level of the output node (C) where the reference voltage VREF is outputted.

The driving element 320 selectively pulls down the node (A) depending on the voltage level of the node (D). The charge element 330, i.e., the MOS capacitor MC, charges the voltage level of the output node (C) to drive and amplify the reference voltage VREF.

For example, if the voltage level of the output node (C) is at a high level, the NMOS transistor N4 is turned on while the PMOS transistor P4 is turned off.

Then, the voltage level of the node (D) changes to a low level to turn off the NMOS transistor N5. The MOS capacitor MC enters into a charge phase.

On the other hand, if the voltage level of the output node (C) is at a low level, the NMOS transistor N4 is turned off while the PMOS transistor P4 is turned on.

Then, the voltage level of the node (D) changes to a high level, so that the NMOS transistor N5 is turned on. As a result, the node (A) changes to a low level, and thus the PMOS transistor P3 is turned on. Subsequently, the output node (C) re-transits to the high level so that the voltage level of the reference voltage VREF increases again.

The temperature variation, as one of the changes occurring during the manufacturing process of the chip, is one of factors that cause unexpected alteration of the generation of the reference voltage VREF.

In an embodiment of the present invention, the NMOS transistors N1 and N2 operate in the weak inversion region by employing a relatively simple self-biased β multiplier as a basic structure.

Thus, the reference voltage VREF, insensitive to the temperature variation, can be generated by using characteristics of the increasing current IPTAT and the decreasing threshold voltage $V_{GS6}$ depending on temperature increase. That is, an embodiment of the present invention uses a cancelling-out (or off-setting) characteristic of the positive and negative temperature coefficients, which are the current IPTAT and the threshold voltage $V_{GS6}$, to secure a reference voltage insensitive to the temperature variation.

Figure 1:
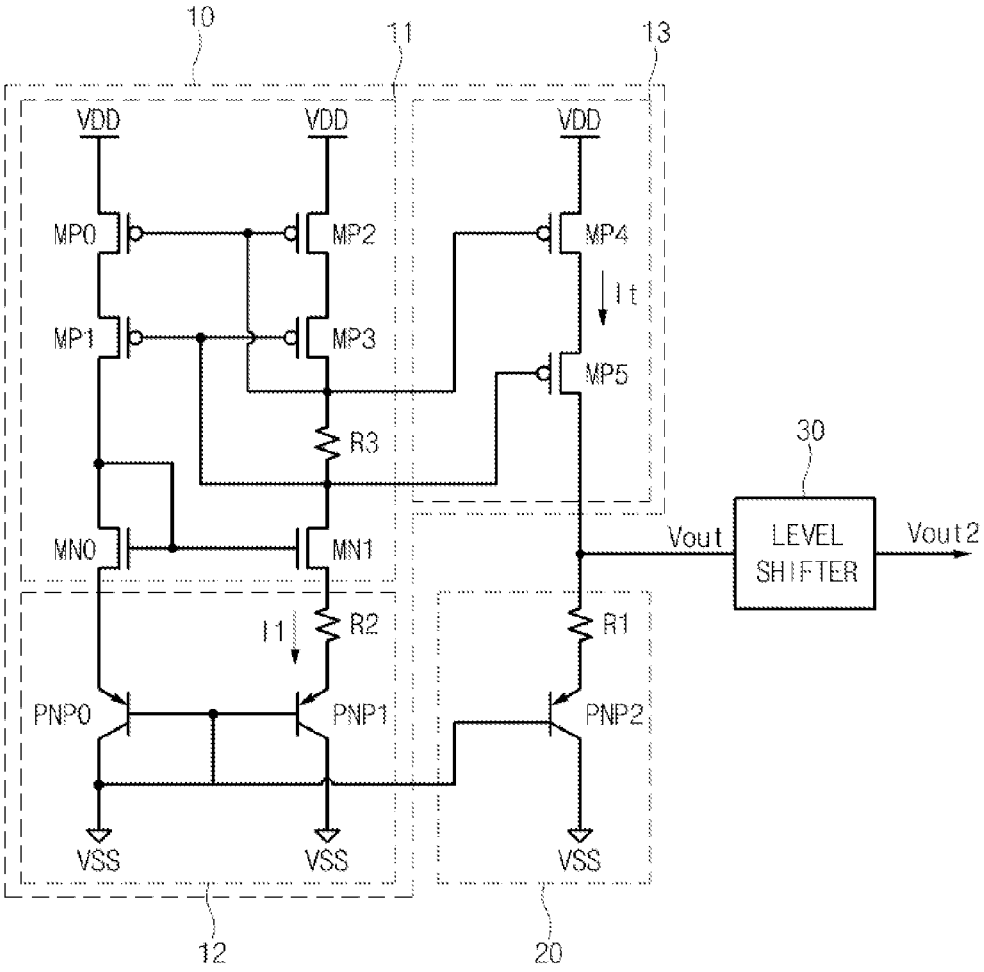
FIG. 1 illustrates a circuit diagram of a conventional reference voltage generator.

Moreover, since the reference voltage generator shown in FIG. 2 includes a small number of MOS field effect transistors (FET), the present invention can be implemented in a smaller area than other existing reference voltage generators, such as the reference voltage generator shown in FIG. 1.

Also, the target current region is set so that the NMOS transistors N1 and N2 may operate in the weak inversion region to reduce current consumption of the reference voltage generator.

Thus, the reference voltage generator according to an embodiment of the present invention provides the following benefits.

First, since the reference voltage generator is implemented by using only MOS transistors and thus the physical layout area of the semiconductor memory device can be reduced, it contributes to improvement of a net die size.

Second, since the NMOS transistors operate in a weak inversion region, the current consumption is reduced.

Third, the present invention provides a reference voltage generator having low temperature dependency and low power voltage dependency to stabilize a source power of a transistor in a chip and improve accuracy in voltage sensing.

Although illustrative embodiments consistent with the present invention have been described, it should be understood that other modifications and embodiments can be devised by those skilled in the art that will fall within the spirit and scope of the principles of this disclosure. Particularly, numerous variations and modifications are possible in the component parts and/or arrangements which are within the scope of the disclosure, the drawings, and the accompanying claims. In addition to the variations and modifications in the component parts and/or arrangements, alternative uses will also be apparent to those skilled in the art.

What is claimed is:

1. A reference voltage generator, comprising:

a current generating unit configured to generate a reference current proportional to a temperature increase;

a voltage adjusting unit configured to output a reference voltage corresponding to a level of the reference current; and a start-up driving unit configured to drive and amplify the reference voltage while the voltage adjusting unit operates, wherein the voltage adjusting unit comprises:

a current supply unit configured to output a supply current to a second node, the supply current corresponding to a changing amount of the reference current; and a diode unit configured to control a current value of the supply current.

2. The reference voltage generator according to claim 1, wherein the current generating unit comprises:

a temperature sensing unit configured to sense a temperature to adjust output impedance according to a temperature variation; and a current mirror unit configured to generate the reference current corresponding to the output impedance and output the reference current to a first node.

3. The reference voltage generator according to claim 2, wherein the temperature sensing unit is configured to reduce the output impedance as the temperature increases.

4. The reference voltage generator according to claim 1, wherein the diode unit is configured to control the current value by inducing a negative temperature coefficient.

5. The reference voltage generator according to claim 1, wherein the diode unit comprises at least one NMOS transistor that is coupled to and disposed between the second node and a ground voltage terminal and that is formed to have a diode type, and wherein a current value of the second node is controlled by using a gate-source voltage of the NMOS transistor as a negative temperature coefficient.

6. The reference voltage generator according to claim 1, wherein the start-up driving unit comprises:

an output driving unit configured to be selectively driven in response to an output signal of the voltage adjusting unit to control a voltage level of the reference voltage;

a driving element configured to selectively pull down an output node of the reference voltage in response to an output signal of the output driving unit; and a charge element configured to charge the output node of the reference voltage.

7. The reference voltage generator according to claim 6, wherein the output driving unit comprises an inverting element that is coupled to and disposed between a power voltage terminal and a ground voltage terminal and that has an input node coupled to the output node of the reference voltage.

8. The reference voltage generator according to claim 6, wherein the driving element comprises at least one NMOS transistor that is coupled to and disposed between an output node of the current generating unit and a ground voltage terminal and that has a gate coupled to an output node of the output driving unit.

9. The reference voltage generator according to claim 6, wherein the charge element includes a MOS capacitor having a gate coupled to the output node of the reference voltage.

10. The reference voltage generator according to claim 6, wherein the driving element is turned off so that the charge element operates when the output node of the reference voltage is at a high level, and wherein the driving element is turned on when the output node of the reference voltage is at a low level.

11. The reference voltage generator according to claim 2, wherein the current mirror unit comprises a pair of PMOS transistors coupled to each other to form a current mirror.

12. The reference voltage generator according to claim 11, wherein the temperature sensing unit comprises a pair of NMOS transistors having a common gate, which are coupled to and disposed between the current mirror unit and a ground voltage terminal and operates in a weak inversion region, a first one of the NMOS transistor pair having a drain coupled to the common gate.

13. The reference voltage generator according to claim 12, wherein the temperature sensing unit further comprises a resistance element between a source of a second one of the NMOS transistor pair and the ground voltage terminal.

14. The reference voltage generator according to claim 1, wherein the current supply unit comprises at least one PMOS transistor that is coupled to and disposed between a power voltage terminal and the second node, and wherein the current supply unit receives the reference current through a gate of the at least one PMOS transistor.

15. The reference voltage generator according to claim 1, wherein the current generating unit is configured to operate in a weak inversion region.

16. The reference voltage generator according to claim 1, wherein the voltage adjusting unit is configured to output the reference voltage by using an offset characteristic of a positive temperature coefficient and a negative temperature coefficient that occurs when the positive temperature coefficient increases and the negative temperature coefficient decreases during a temperature increase, so that the reference voltage becomes substantially insensitive to the temperature variation, and wherein the positive temperature coefficient corresponds to the reference current.

* * * * *